US007089611B1

(12) United States Patent
Jones et al.

(10) Patent No.: US 7,089,611 B1
(45) Date of Patent: Aug. 15, 2006

(54) BED SKIRT SYSTEM

(76) Inventors: Barbara R. Jones, 1259 Witherington Rd., Mason, TN (US) 38049; Laloma Harris, 1259 Witherington Rd., Mason, TN (US) 38049

( * ) Notice: Subject to any disclaimer, the term of this patent is extended or adjusted under 35 U.S.C. 154(b) by 0 days.

(21) Appl. No.: 11/182,185

(22) Filed: Jul. 15, 2005

(51) Int. Cl.
*A47C 21/00* (2006.01)

(52) U.S. Cl. ..... 5/493; 5/482

(58) Field of Classification Search ..... 5/482, 5/498, 493, 411, 923
See application file for complete search history.

(56) References Cited

U.S. PATENT DOCUMENTS

| | | | | |
|---|---|---|---|---|
| 3,999,233 | A | 12/1976 | Morris | |
| 4,726,083 | A * | 2/1988 | Hoshall | 5/411 |
| 4,807,316 | A | 2/1989 | Whipple | |
| D339,495 | S | 9/1993 | Murray | |
| 5,335,383 | A | 8/1994 | Schwind | |
| 5,353,456 | A | 10/1994 | Evans | |
| 5,621,931 | A | 4/1997 | Hamilton | |
| 5,715,553 | A | 2/1998 | Baron et al. | |
| 5,733,397 | A | 3/1998 | McDaniel | |
| 6,035,469 | A | 3/2000 | Schrougham | |
| 6,276,009 | B1 | 8/2001 | Schrougham | |

* cited by examiner

*Primary Examiner*—Michael Trettel

(57) ABSTRACT

A bed skirt system includes a bed skirt that includes a cloth panel that has a perimeter edge, a top side and bottom side. The perimeter edge includes a front edge, a back edge, a first side edge and a second side edge. A cloth perimeter flap is attached to and extends downwardly from the first side edge, the second side edge and the front edge. A coupler is configured to removably attach the bottom side of the panel to an upper surface of the box spring. The bed skirt is positioned on the box spring and secured thereto with the coupler.

3 Claims, 2 Drawing Sheets

BED SKIRT SYSTEM

BACKGROUND OF THE INVENTION

1. Field of the Invention

The present invention relates to bed skirt devices and more particularly pertains to a new bed skirt device for retaining a bed skirt on a box spring so that it does not easily shift when a mattress is placed on the box spring.

2. Description of the Prior Art

The use of bed skirt devices is known in the prior art. U.S. Pat. No. 5,715,553 describes a bed skirt device that is extendable around and attached to bed spring. Another type of bed skirt device is U.S. Pat. No. 3,999,233 again which is extendable around and attachable to a box spring. Still another bed skirt device is found in U.S. Pat. No. 5,621,931 and includes a skirt that is selectively detachable from a panel positioned on top of a box spring.

While these devices fulfill their respective, particular objectives and requirements, the need remains for a device that is easily securable to a box spring and which functions generally as a conventional bed skirt. The device should remain in place when a mattress is positioned on the box spring so that a user need not struggle with repositioning the bed skirt so that it is properly aligned with the box spring.

SUMMARY OF THE INVENTION

The present invention meets the needs presented above by generally comprising a bed skirt that includes a cloth panel that has a perimeter edge, a top side and bottom side. The perimeter edge includes a front edge, a back edge, a first side edge and a second side edge. A cloth perimeter flap is attached to and extends downwardly from the first side edge, the second side edge and the front edge. A coupler is configured to removably attach the bottom side of the panel to an upper surface of the box spring. The bed skirt is positioned on the box spring and secured thereto with the coupler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
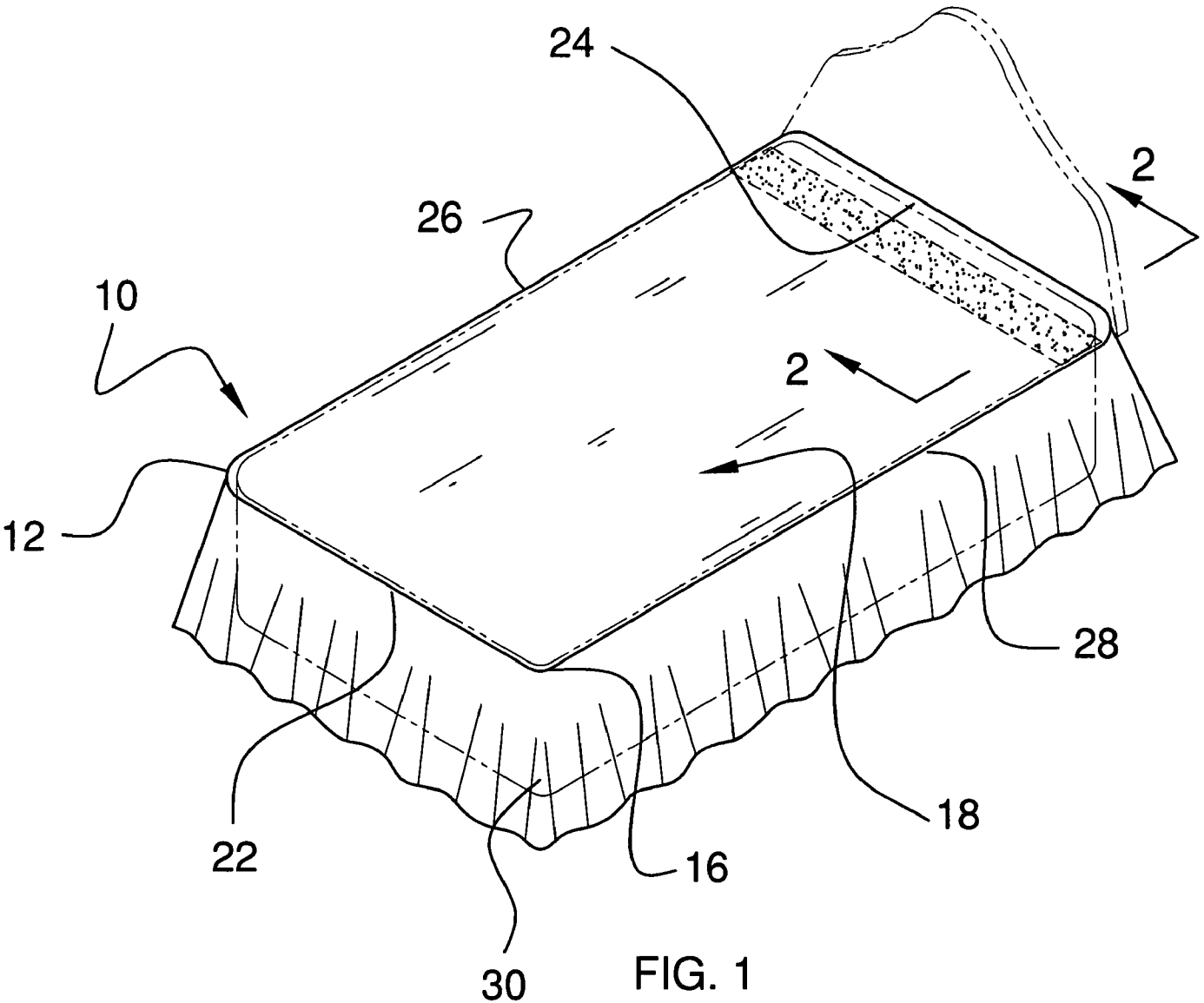
FIG. 1 is a perspective in-use view of a bed skirt system according to the present invention.
Figure 2:
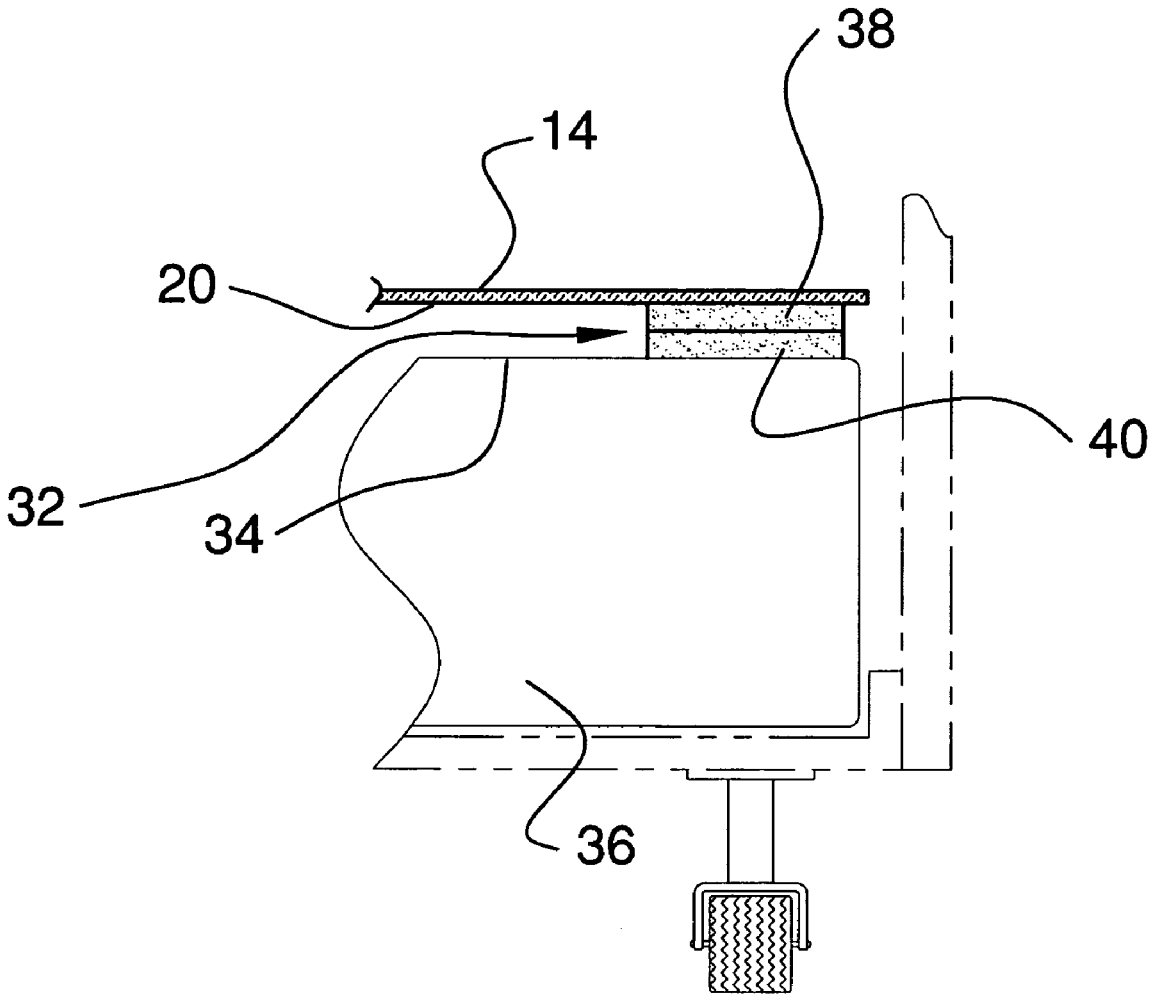
FIG. 2 is a cross-sectional view taken along line 2—2 of FIG. 1 of the present invention.

With reference now to the drawings, and in particular to FIGS. 1 and 2 thereof, a new bed skirt device embodying the principles and concepts of the present invention and generally designated by the reference numeral 10 will be described.

As best illustrated in FIGS. 1 and 2, the bed skirt system 10 generally comprises a bed skirt 12 including a cloth panel 14 that has a perimeter edge 16, a top side 18 and bottom side 20. The perimeter edge 16 includes a front edge 22, a back edge 24, a first side edge 26 and a second side edge 28. A cloth perimeter flap 30 is attached to and extends downwardly from the first side edge 26, the second side edge 28 and the front edge 22.

A coupler 32 is configured to removably attach the bottom side 20 of the panel 14 to an upper surface 34 of a box spring 36. The coupler 32 includes a first mating member 38 attached to the bottom side 20 and a second mating member 40 attached to the box spring 36. The first mating member 38 is positioned adjacent to the back edge 24. The second mating member 40 is positioned to align with the first mating member 38 when the panel 14 is aligned with the box spring 36. The coupler 32 comprises a hook and loop securing means. The first mating member 38 extends along the back edge 24.

In use, the bed skirt 12 is positioned on the box spring 36 and secured thereto with the coupler 32. When a mattress is positioned on the panel 14, the coupler 32 prevents the panel 14 from moving and thereby retains the bed skirt 12 in a more aligned orientation. If the panel 14 does shift, it may be easily re-aligned as the back edge 24 of the panel 14 will not be moved when the front edge 22 is aligned with a front wall of the box spring 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bed skirt system for covering a box spring with a bed skirt, said system comprising:

a bed skirt including a cloth panel having a perimeter edge, a top side and bottom side, said perimeter edge including a front edge, a back edge, a first side edge and a second side edge, a cloth perimeter flap being attached to and extending downwardly from said first side edge, said second side edge and said front edge;

a coupler being configured to removably attach said bottom side of said panel to an upper surface of said box spring, said coupler including a first mating member attached to said bottom side and a second mating member attached to the upper surface of said box spring; and wherein said bed skirt is positioned on the box spring and secured hereto with said coupler.

2. The system according to claim 1, wherein said first mating member is positioned adjacent to said back edge, said second mating member being positioned to align with said first mating member when said panel is aligned with the box spring.

3. A bed skirt system for covering a box spring with a bed skirt, said system comprising:

a bed skirt including a cloth panel having a perimeter edge, a top side and bottom side, said perimeter edge including a front edge, a back edge, a first side edge and a second side edge, a cloth perimeter flap being attached to and extending downwardly from said first side edge, said second side edge and said front edge;

a coupler being configured to removably attach said bottom side of said panel to an upper surface of said box spring, said coupler including a first mating member attached to said bottom side and a second mating member attached to said box spring, said first mating member being positioned adjacent to said back edge, said second mating member being positioned to align with said first mating member when said panel is aligned with the box spring, said coupler comprising a hook and loop securing means; and wherein said bed skirt is positioned on the box spring and secured thereto with said coupler.

* * * * *